US011488473B2

(12) United States Patent
Kaneichi

(10) Patent No.: US 11,488,473 B2
(45) Date of Patent: Nov. 1, 2022

(54) APPARATUS, METHOD, AND SYSTEM FOR SETTING A SPECIAL LANE FOR TRAVELING OF AN EMERGENCY VEHICLE

(71) Applicant: Toyota Jidosha Kabushiki Kaisha, Toyota (JP)

(72) Inventor: Daiki Kaneichi, Tokyo-to (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 38 days.

(21) Appl. No.: 17/130,651

(22) Filed: Dec. 22, 2020

(65) Prior Publication Data

US 2021/0192945 A1 Jun. 24, 2021

(30) Foreign Application Priority Data

Dec. 24, 2019 (JP) ..... JP2019-233524

(51) Int. Cl.

| | |
|---|---|
| ***G08G 1/087*** | (2006.01) |
| ***E01C 17/00*** | (2006.01) |
| ***G08G 1/01*** | (2006.01) |
| ***G08G 1/081*** | (2006.01) |

(52) U.S. Cl.

CPC ..... *G08G 1/087* (2013.01); *E01C 17/00* (2013.01); *G08G 1/0145* (2013.01); *G08G 1/081* (2013.01)

(58) Field of Classification Search

CPC ..... G08G 1/0145; G08G 1/087; E01C 17/00

See application file for complete search history.

(56) References Cited

U.S. PATENT DOCUMENTS

| | | | | |
|---|---|---|---|---|
| 10,885,780 | B1 * | 1/2021 | Bseileh | G08G 1/087 |
| 2007/0048084 | A1 * | 3/2007 | Jung | G09F 9/35 404/9 |
| 2020/0200563 | A1 * | 6/2020 | Martin | G08G 1/0145 |
| 2020/0242922 | A1 * | 7/2020 | Dulberg | G08G 1/096708 |
| 2020/0313848 | A1 * | 10/2020 | Troia | H04L 9/006 |
| 2020/0320883 | A1 | 10/2020 | Li | |
| 2021/0043078 | A1 * | 2/2021 | Chen | G08G 1/0965 |
| 2021/0087756 | A1 * | 3/2021 | Shah | E01C 5/00 |
| 2021/0183246 | A1 * | 6/2021 | Zack | E01F 9/50 |

FOREIGN PATENT DOCUMENTS

| | | | |
|---|---|---|---|
| CN | 107438085 | A | 12/2017 |
| CN | 108091149 | A | 5/2018 |
| CN | 110136463 | A | 8/2019 |
| JP | 2003-115094 | A | 4/2003 |
| JP | 2018-085151 | A | 5/2018 |
| JP | 2019-168998 | A | 10/2019 |

* cited by examiner

*Primary Examiner* — Andrew W Bee

(74) *Attorney, Agent, or Firm* — Dinsmore & Shohl LLP

(57) ABSTRACT

An object of the present disclosure is to enable an emergency vehicle to travel more smoothly to a destination. An information processing apparatus sets a special lane for traveling of an emergency vehicle on a road on a scheduled travel route along which the emergency vehicle travels to reach a destination. Furthermore, the information processing apparatus transmits a display command to display the special lane to a display apparatus that displays information along a lane on a road surface of the road on the scheduled travel route.

17 Claims, 9 Drawing Sheets

| SECTION | SECTION AB | SECTION BC | SECTION CD | ... |
|---|---|---|---|---|
| DISPLAY START TIME | 8:50 | 9:10 | 9:30 | ... |

APPARATUS, METHOD, AND SYSTEM FOR SETTING A SPECIAL LANE FOR TRAVELING OF AN EMERGENCY VEHICLE

CROSS REFERENCE TO THE RELATED APPLICATION

This application claims the benefit of Japanese Patent Application No. 2019-233524, filed on Dec. 24, 2019, which is hereby incorporated by reference herein in its entirety.

BACKGROUND

Technical Field

The present disclosure relates to traffic management at the time of traveling of an emergency vehicle.

Description of the Related Art

Patent document 1 discloses an accident information distribution system. The accident information distribution system disclosed in Patent document 1 includes a camera that is installed at a roadside. The camera is activated in response to information indicating occurrence of an accident on a road. Then, image data captured by the camera is distributed to terminals via a center that collects the image data.

Patent document 2 discloses a traffic light control apparatus. The traffic light control apparatus disclosed in Patent document 2 switches a display state of a signal display unit in a case where an emergency vehicle is detected, so as to allow the emergency vehicle to proceed.

Patent document 3 discloses a technique according to which a server apparatus transmits a request to stop at a side of a road to a non-emergency vehicle that is on a scheduled travel route of an emergency vehicle.

CITATION LIST

Patent Document

[Patent document 1] Japanese Patent Laid-Open No. 2003-115094

[Patent document 2] Japanese Patent Laid-Open No. 2018-085151

[Patent document 3] Japanese Patent Laid-Open No. 2019-168998

SUMMARY

An object of the present disclosure is to enable an emergency vehicle to travel more smoothly to a destination.

An information processing apparatus according to a first aspect of the present disclosure includes a controller that is configured to:

set a special lane for traveling of an emergency vehicle on a road on a scheduled travel route along which the emergency vehicle travels to reach a destination; and transmit a display command to display the special lane to a display apparatus that displays information along a lane on a road surface of the road on the scheduled travel route.

An information processing method according to a second aspect of the present disclosure is an information processing method to be performed by a computer, the information processing method including:

setting a special lane for traveling of an emergency vehicle on a road on a scheduled travel route along which the emergency vehicle travels to reach a destination; and transmitting a display command to display the special lane to a display apparatus that displays information along a lane on a road surface of the road on the scheduled travel route.

A system according to a third aspect of the present disclosure is a system including a display apparatus that is configured to display information along a lane on a road surface of a road, and an information processing apparatus, where the information processing apparatus sets a special lane for traveling of an emergency vehicle on a road on a scheduled travel route along which the emergency vehicle travels to reach a destination, and transmits a display command to display the special lane on a road surface of the road on the scheduled travel route to the display apparatus, and the display apparatus receiving the display command displays the special lane on the road surface of the road on the scheduled travel route.

According to the present disclosure, an emergency vehicle may be enabled to travel more smoothly to a destination.

DESCRIPTION OF THE EMBODIMENTS

Figure 1:
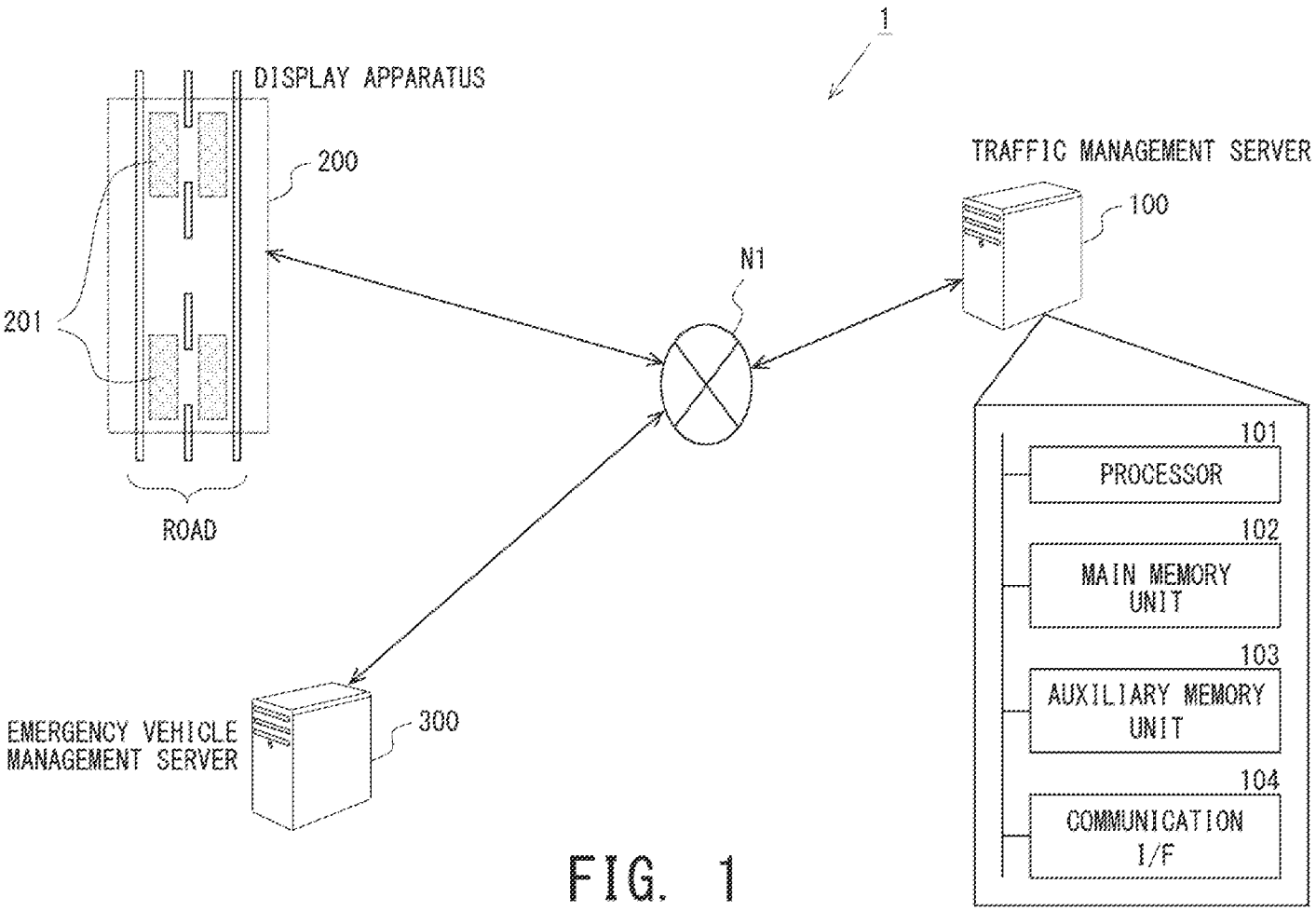
FIG. 1 is a diagram illustrating a schematic configuration of a traffic management system according to a first embodiment.

With an information processing apparatus according to a first aspect of the present disclosure, a controller may set a special lane on a road on a scheduled travel route along which an emergency vehicle travels to reach a destination. The emergency vehicle here is a vehicle that is legally determined to be able to preferentially travel on a road in the case of an emergency operation. As the emergency vehicle, an ambulance, a fire engine, or a police car may be cited. The special lane is a lane where the emergency vehicle is to travel. That is, in the case where the special lane is set on a road on a scheduled travel route, the emergency vehicle travels on the lane that is set as the special lane.

Furthermore, the controller may transmit, to a display apparatus, a display command to display the special lane. The display apparatus here is an apparatus that displays information along a lane on a road surface of a road. The display apparatus displays information in the form of text or sign, for example. Furthermore, the display apparatus may be capable of changing display contents. The display apparatus notifies a vehicle traveling on a road of information about traffic on the road, by displaying information on the road surface of the road.

When the display command as described above is transmitted from the information processing apparatus according to the present disclosure to the display apparatus, the display apparatus displays the special lane using information, on the road surface of the road on the scheduled travel route. That is, the display apparatus displays, on the road surface of the road on the scheduled travel route, information indicating that a lane on the road (a lane that is set as the special lane) is made a lane where the emergency vehicle is to travel. Vehicles, other than the emergency vehicle, traveling on the road on the scheduled travel route of the emergency vehicle are thus notified of the lane where the emergency vehicle is to travel. Accordingly, other vehicles may be urged to move over from the lane that is set as the special lane and to not enter the lane that is set as the special lane. As a result, traveling of the emergency vehicle on the lane that is set as the special lane on the road on the scheduled travel route may be prevented from being obstructed by other vehicles. Therefore, the emergency vehicle may travel more smoothly to the destination.

In the following, specific embodiments of the present disclosure will be described with reference to the drawings. Dimensions, materials, shapes, relative positions and the like of structural components described in the present embodiments are not intended to limit the technical scope of the disclosure unless stated otherwise.

First Embodiment

An embodiment where an information processing apparatus, an information processing method, and a system according to the present disclosure are applied to a traffic management system will be described. The traffic management system according to the present embodiment is a system for managing traffic at the time of traveling of an emergency vehicle. The emergency vehicle in this case may be any of an ambulance, a fire engine, a police car and the like.

(Overview of System)

FIG. 1 is a diagram illustrating a schematic configuration of the traffic management system according to the present embodiment. A traffic management system 1 includes a traffic management server 100, a display apparatus 200, and an emergency vehicle management server 300. Furthermore, in the traffic management system 1, the traffic management server 100, the display apparatus 200, and the emergency vehicle management server 300 are interconnected via a network N1. As the network N1, a wide area network (WAN), which is a worldwide public communication network such as the Internet, or a telephone communication network for mobile phones may be adopted, for example.

The traffic management server 100 controls road surface display by the display apparatus 200 as described later so as to manage traveling of various vehicles traveling on a road. The traffic management server 100 is configured by including a general computer. The computer constituting the traffic management server 100 includes a processor 101, a main memory unit 102, an auxiliary memory unit 103, and a communication interface (communication I/F) 104.

The processor 101 here is a central processing unit (CPU) or a digital signal processor (DSP), for example. The main memory unit 102 is a random access memory (RAM), for example. The auxiliary memory unit 103 is a read only memory (ROM), a hard disk drive (HDD), or a flash memory, for example. The auxiliary memory unit 103 may also be a removal medium (removable recording medium). The removable medium here is an USB memory, an SD card, or a disk recording medium such as a CD-ROM, a DVD disc or a Blu-ray disc, for example. The communication I/F 104 is a local area network (LAN) interface board or a wireless communication circuit for wireless communication, for example.

The auxiliary memory unit 103 stores the operating system (OS), various programs, various information tables and the like. Road surface display by the display apparatus 200 as described later is controlled by the processor 101 loading programs stored in the auxiliary memory unit 103 into the main memory unit 102 and executing the same. However, one or some or all of functions of the traffic management server 100 may be implemented by a hardware circuit such as an ASIC or an FPGA. Moreover, the traffic management server 100 does not necessarily have to be implemented by one physical component, and may be configured by a plurality of computers that coordinate with one another.

The display apparatus 200 is an apparatus that displays information along a lane on the road surface of a road. The display apparatus 200 includes a plurality of light emitting bodies (such as LEDs) 201 that are embedded in the road surface of a road, along a lane. The display apparatus 200 displays information on the road surface of a road in the form of text or sign by causing at least one of the plurality of light emitting bodies 201 to emit light. The text or sign displayed on the road surface of a road by the display apparatus 200 is viewed from a vehicle traveling on the road. A vehicle traveling on the road is thereby notified of information about traffic on the road.

Additionally, means used by the display apparatus 200 to display information in the form of text or sign on the road surface of a road are not limited to the light emitting bodies embedded in the road surface. For example, the display apparatus 200 may display text or sign by projecting an image on the road surface of a road. It should be noted that the display apparatus 200 has to display text or sign along a lane on the road.

The emergency vehicle management server 300 manages traveling of an emergency vehicle. The emergency vehicle management server 300 is configured by including a general computer. Like the computer constituting the traffic management server 100, the computer constituting the emergency vehicle management server 300 includes a processor, a main memory unit, an auxiliary memory unit, and a communication I/F. At the time of traveling of an emergency vehicle, the emergency vehicle management server 300 creates a scheduled travel route to a destination of the emergency vehicle and a travel schedule (time schedule) at the time of the emergency vehicle traveling on the scheduled travel route.

In the traffic management system 1, at the time of traveling of an emergency vehicle, information indicating the scheduled travel route of the emergency vehicle is transmitted from the emergency vehicle management server 300 to the traffic management server 100. Then, traffic management server 100 sets a special lane that is to be a lane where the emergency vehicle travels, on a road on the scheduled travel route of the emergency vehicle. Furthermore, the traffic management server 100 transmits a display command to display the special lane, to the display apparatus 200 that performs road surface display on the road on the scheduled travel route. The display apparatus 200 displays the special lane on the road on the scheduled travel route using the light emitting body 201, based on the display command received from the traffic management server 100. That is, the display apparatus 200 displays text or sign indicating that the lane is the special lane, using the light emitting body 201 embedded in the lane that is set as the special lane.

(Functional Configuration)

Figure 2:
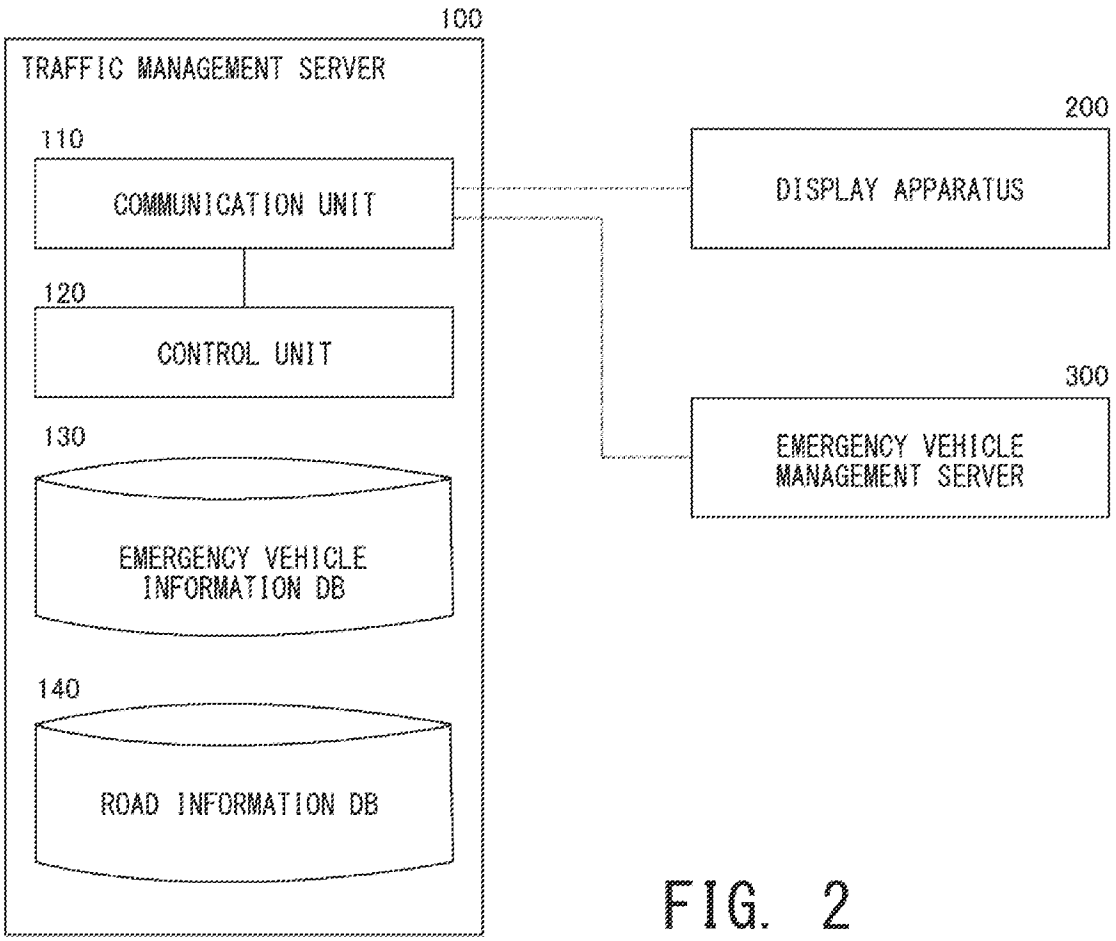
FIG. 2 is a block diagram schematically illustrating an example of a functional configuration of a traffic management server.

Next, a functional configuration of the traffic management server according to the present embodiment will be described with reference to FIG. 2. FIG. 2 is a block diagram schematically illustrating an example of the functional configuration of the traffic management server 100.

The traffic management server 100 includes a communication unit 110, a control unit 120, an emergency vehicle information database (emergency vehicle information DB) 130, and a road information database (road information DB) 140. The control unit 120 has a function of performing arithmetic processing to control the traffic management server 100. The control unit 120 may be implemented by the processor 101.

The communication unit 110 has a function of connecting the traffic management server 100 to the network N1. The communication unit 110 may be implemented by the communication I/F 104. The control unit 120 performs a process of receiving, via the communication unit 110, information indicating the scheduled travel route of an emergency vehicle that is transmitted from the emergency vehicle management server 300. Furthermore, the control unit 120 performs a process of storing, in the emergency vehicle information DB 130, the scheduled travel route of the emergency vehicle included in the information received from the emergency vehicle management server 300. A vehicle ID for identifying an emergency vehicle and the scheduled travel route of the emergency vehicle are stored in the emergency vehicle information DB 130 in association with each other.

Additionally, the traffic management server 100 does not necessarily have to receive the scheduled travel route of an emergency vehicle from the emergency vehicle management server 300. For example, the traffic management server 100 may receive information indicating the scheduled travel route of an emergency vehicle from the emergency vehicle. Alternatively, the traffic management server 100 may receive information indicating a current location and a destination of an emergency vehicle from the emergency vehicle management server 300 or the emergency vehicle, and may create the scheduled travel route of the emergency vehicle based on such information.

Furthermore, the control unit 120 performs a process of transmitting a display command to display the special lane to the display apparatus 200 via the communication unit 110. The process of transmitting the display command to the display apparatus 200 that is performed by the control unit 120 will be described later.

Information about each road in a region where traffic is managed by the traffic management server 100 is stored in the road information DB 140. Here, the number of lanes on each road may be cited as the information that is stored in the road information DB 140. Furthermore, the information that is stored in the road information DB 140 may include information about lane restrictions on each road or information indicating a trend in the amount of traffic on each lane on each road, for example. The emergency vehicle information DB 130 and the road information DB 140 are structured in the auxiliary memory unit 103 by the processor 101 executing a database management system program.

(Road Surface Display Control)

Figure 3:
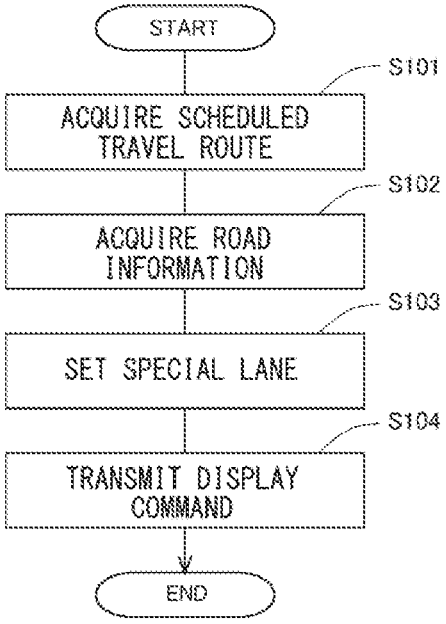
FIG. 3 is a flowchart according to the first embodiment, illustrating a flow of information processing that is performed by a control unit of a display apparatus at a time of traveling of an emergency vehicle.

Next, information processing that is performed by the traffic management server 100 in the present embodiment to control road surface display by the display apparatus 200 will be described with reference to FIG. 3. FIG. 3 is a flowchart illustrating a flow of information processing that is performed by the control unit 120 of the traffic management server 100 at a time of traveling of an emergency vehicle.

In the present flow, first, the scheduled travel route of an emergency vehicle that is stored in the emergency vehicle information DB 130 is acquired in S101. Next, in S102, information about a road on the scheduled travel route of the emergency vehicle, that is stored in the road information DB 140, is acquired.

Next, in S103, a special lane that is to be the lane where the emergency vehicle travels is set on the road on the scheduled travel route of the emergency vehicle based on the scheduled travel route of the emergency vehicle acquired in S101 and the road information acquired in S102. At this time, the control unit 120 may set the special lane according to certain rules such as setting a passing lane as the special lane, for example. Furthermore, the control unit 120 may set the special lane based on information about lane restrictions or information indicating a trend in the amount of traffic on each lane on each road, such information being included in the road information.

Next, in S104, the display command to display the special lane that is set in S103 is transmitted to the display apparatus 200 that is to perform road surface display on the road on the scheduled travel route of the emergency vehicle.

Additionally, the traffic management server 100 may receive, from the emergency vehicle management server 300, information indicating the number of emergency vehicles that are scheduled to travel on the scheduled travel route, together with the information indicating the scheduled travel route of the emergency vehicle. Then, at the time of performing the process in S103 in the flow described above, the control unit 120 may determine the number of lanes to be set as the special lane, based on the number of emergency vehicles that are scheduled to travel on the scheduled travel route. For example, the number of lanes to be set as the special lane may be one when the number of emergency vehicles that are scheduled to travel on the scheduled travel route is less than a predetermined number, and the number of lanes to be set as the special lane may be more than one when the number of emergency vehicles that are scheduled to travel on the scheduled travel route is the predetermined number or more.

(Effects of Road Surface Display)

When the display command is transmitted to the display apparatus 200 by execution of the information processing described above by the traffic management server 100, the display apparatus 200 displays, based on the display command, the special lane on the road on the scheduled travel route of the emergency vehicle using the light emitting body 201.

Figure 4:
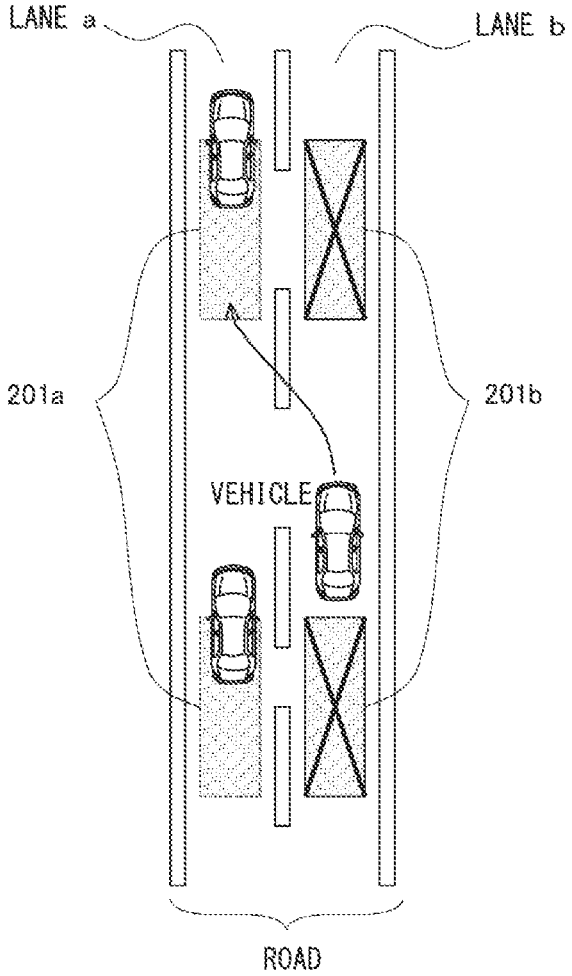
FIG. 4 is a diagram illustrating an example state of a road when the display apparatus displays, by a light emitting body, a special lane on a road on a scheduled travel route of an emergency vehicle.

FIG. 4 is a diagram illustrating an example state of a road when the display apparatus 200 displays, by the light emitting body 201, the special lane on the road on the scheduled travel route of the emergency vehicle. Additionally, display contents by text or sign at the time of indicating the special lane by the light emitting body 201 are set in advance. In FIG. 4, the road includes two lanes of a lane a and a lane b. Furthermore, light emitting bodies 201*a* are embedded in the lane a, and light emitting bodies 201*b* are embedded in the lane b. Moreover, FIG. 4 illustrates a state where, of the lane a and the lane b, the lane b is set as the special lane.

In FIG. 4, that the lane b is made the special lane, or in other words, that the lane b is to be used for traveling of the emergency vehicle, is displayed by the light emitting bodies 201*b*. Vehicles, other than the emergency vehicle, traveling on the road on the scheduled travel route of the emergency vehicle are thereby notified to the effect that the emergency vehicle will be traveling on the lane b. The vehicle traveling on the lane b may thus be urged to perform traveling as indicated by an arrow in FIG. 4 and to move over from the lane b. Furthermore, the vehicle traveling on the lane a may be urged not to travel to enter the lane b. As a result, when the emergency vehicle travels on the lane b, traveling may be prevented from being obstructed by other vehicles.

As described above, with the traffic management system according to the present embodiment, when an emergency vehicle is to travel on a scheduled travel route to a destination, traveling may be prevented from being obstructed by other vehicles. Accordingly, the emergency vehicle may be enabled to travel more smoothly to the destination.

Furthermore, for example, in the case where a traffic light is installed at an intersection of a road on the scheduled travel route of the emergency vehicle and another road, entry of vehicles other than the emergency vehicle from the other road into the road on the scheduled travel route may be prevented by controlling display of the traffic light. However, in this case, the location where entry of vehicles other than the emergency vehicle into a road on the scheduled travel route of the emergency vehicle may be prevented is limited to the intersection where the traffic light is installed. In contrast, with the traffic management system according to the present embodiment, road surface display for indicating the special lane by the light emitting body 201 of the display apparatus 200 is performed along the lane on the road on the scheduled travel route of the emergency vehicle. Accordingly, traveling of the emergency vehicle may be prevented from being obstructed by other vehicles in a wider range on the scheduled travel route of the emergency vehicle including locations other than intersections.

Second Embodiment

A schematic configuration of a traffic management system according to the present embodiment is the same as that in the first embodiment. Also in the present embodiment, road surface display is performed by the display apparatus 200 at the time of traveling of an emergency vehicle. In the present embodiment, the scheduled travel route of the emergency vehicle is divided into a plurality of sections. The time at which the special lane is displayed on the road surface of a road by the light emitting body 201 is changed for each section. More specifically, the special lane is displayed in each section by the light emitting body 201 from a time point that is a predetermined time before a scheduled time at which the emergency vehicle is to pass through (hereinafter referred to also as "scheduled passing time").

Figure 5:
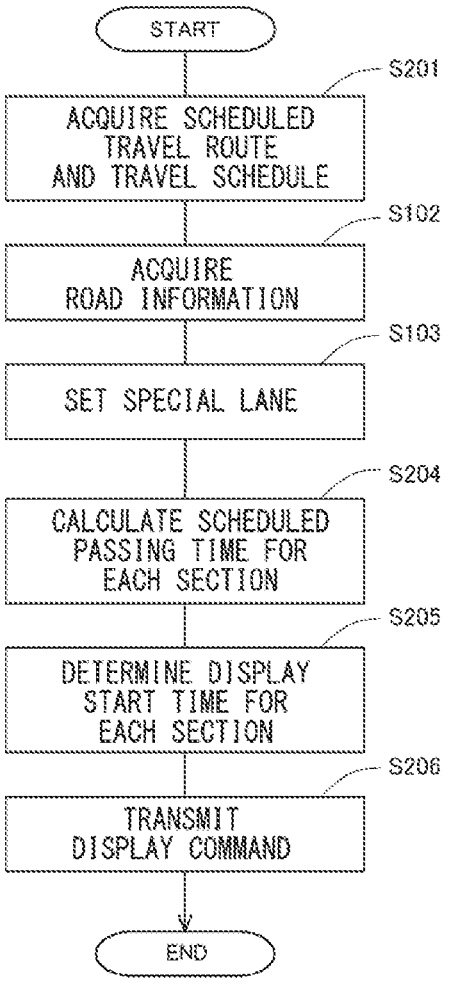
FIG. 5 is a flowchart according to a second embodiment, illustrating a flow of information processing that is performed by a control unit of the traffic management server at a time of traveling of an emergency vehicle.

In the following, information processing of controlling road surface display by the display apparatus 200 that is performed by the traffic management server 100 in the present embodiment will be described with reference to FIG. 5. FIG. 5 is a flowchart illustrating a flow of information processing that is performed by the control unit 120 of the traffic management server 100 at a time of traveling of an emergency vehicle. Additionally, processes in S102 and S103 in the present flowchart are the same as the processes in S102 and S103 in the flowchart illustrated in FIG. 3, respectively. Accordingly, description of the processes in these steps will be omitted.

In the present flow, first, the scheduled travel route and the travel schedule of an emergency vehicle that are stored in the emergency vehicle information DB 130 are acquired in S201. Next, the processes in S102 and S103 are performed. Then, in S204, the scheduled travel route of the emergency vehicle acquired in S101 is divided into a plurality of sections. Furthermore, the scheduled passing time of the emergency vehicle for each section is calculated based on the travel schedule of the emergency vehicle acquired in S101. Additionally, the scheduled passing time of the emergency vehicle for each of the plurality of sections on the scheduled travel route may be included in the travel schedule of the emergency vehicle stored in the emergency vehicle information DB 130. In this case, the process in S204 may be omitted.

Next, in S205, a display start time of the special lane by the light emitting body 201 (hereinafter referred to simply as "display start time") in each section is determined based on the scheduled passing time of the emergency vehicle for each section calculated in S204. At this time, a time point that is a predetermined time before a start time point of the scheduled passing time of the emergency vehicle in each section is determined as the display start time. Next, in S206, a display command to display the special lane on the road surface of the road in each section of the scheduled travel route of the emergency vehicle from the display start time determined in S205 is transmitted to the display apparatus 200 that performs road surface display on the road in each section.

Due to execution of the information processing described above by the traffic management server 100, display of the special lane by the light emitting body 201 is started by the display apparatus 200 in each section of the scheduled travel route of the emergency vehicle from the display start time.

Figure 6:
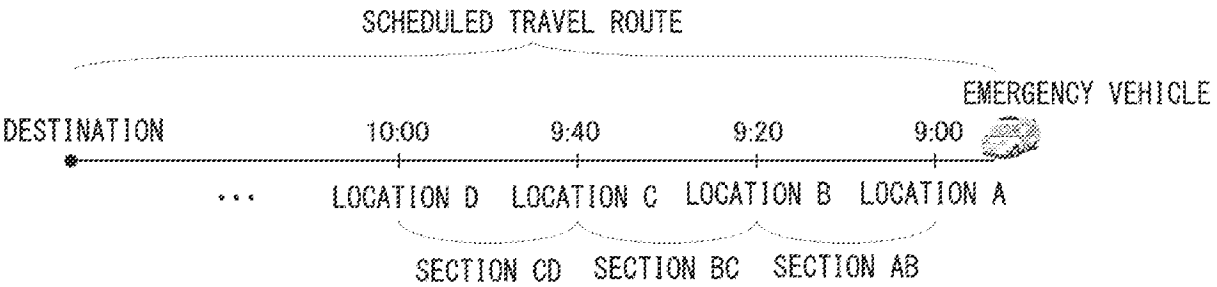
FIG. 6 is a diagram for describing an example of a plurality of sections of a scheduled travel route of an emergency vehicle, a scheduled passing time for each section, and a display start time for each section.

FIG. 6 is a diagram for describing an example of a plurality of sections of the scheduled travel route of an emergency vehicle, the scheduled passing time for each section, and the display start time for each section for when the information processing described above is performed by the traffic management server 100. In FIG. 6, the scheduled travel route of the emergency vehicle includes a section AB from a location A to a location B, a section BC from the location B to a location C, and a section CD from the location C to a location D. The scheduled passing time of the emergency vehicle in the section AB is 9:00 to 9:20. The scheduled passing time of the emergency vehicle in the section BC is 9:20 to 9:40. The scheduled passing time of the emergency vehicle in the section CD is 9:40 to 10:00. Moreover, in FIG. 6, a time point that is 10 minutes before the start time point of the scheduled passing time of the emergency vehicle is determined, for each section, as the display start time (that is, "predetermined time" in the process in S205 in the flowchart illustrated in FIG. 5 is 10 minutes). As a result, the display start time for the section AB is 8:50. Furthermore, the display start time for the section BC is 9:10. The display start time for the section CD is 9:30.

Here, as described above, when the special lane is displayed on the road surface of a road, traveling of vehicles other than the emergency vehicle on the lane that is made the special lane is restricted. Accordingly, if display indicating the special lane is performed for an unnecessarily long period of time, traffic of vehicles other than the emergency vehicle is possibly excessively affected. In contrast, in the present embodiment, the time when the special lane is displayed on the road surface of a road on the scheduled travel route of the emergency vehicle is changed on a per-section basis. Accordingly, display of the special lane may be prevented from being performed for an unnecessarily long period of time. Therefore, an influence on the traffic of vehicles other than the emergency vehicle may be suppressed while preventing traveling of the emergency vehicle to the destination from being obstructed by other vehicles.

Third Embodiment

Figure 7:
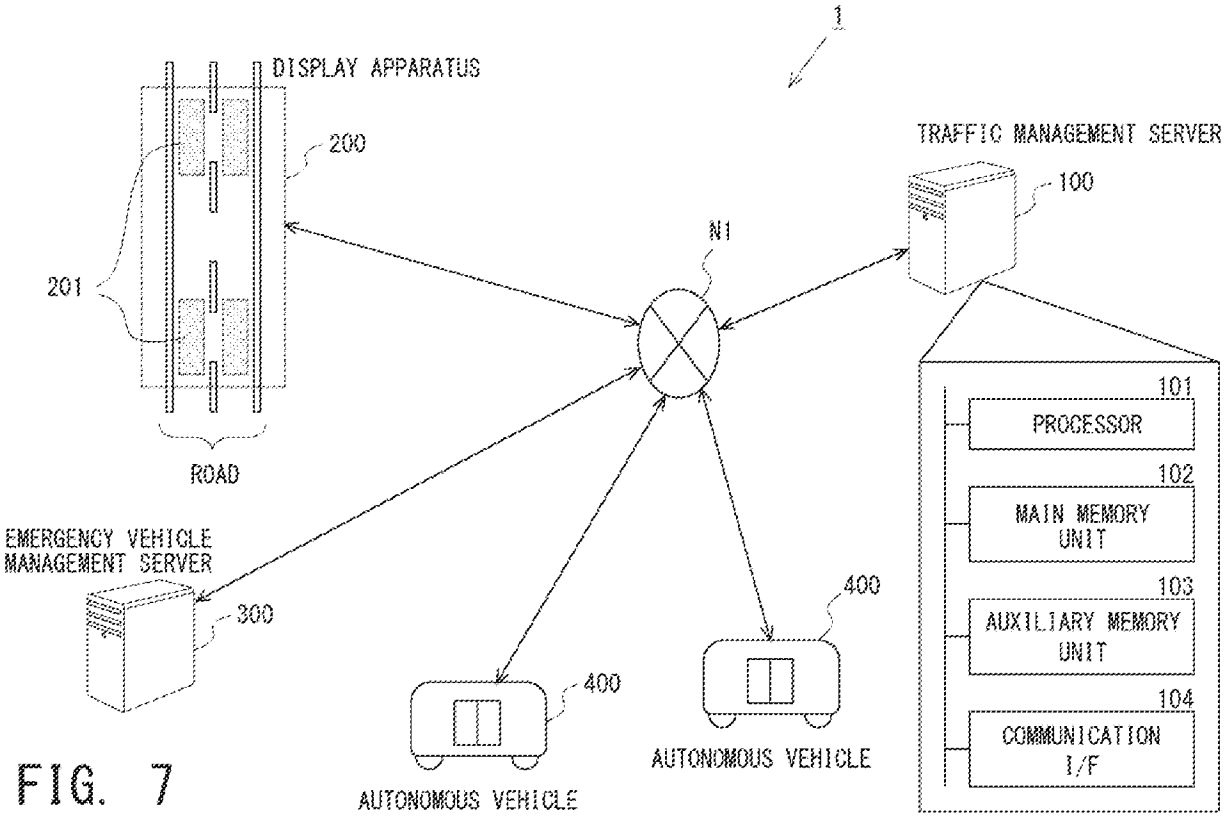
FIG. 7 is a diagram illustrating a schematic configuration of a traffic management system according to a third embodiment.

FIG. 7 is a diagram illustrating a schematic configuration of a traffic management system according to the present embodiment. In the present embodiment, the traffic management system 1 includes a plurality of autonomous vehicles 400, in addition to the traffic management server 100, the display apparatus 200, and the emergency vehicle management server 300. Furthermore, in the traffic management system 1, the traffic management server 100, the display apparatus 200, the emergency vehicle management server 300, and each autonomous vehicle 400 are interconnected via the network N1.

The autonomous vehicle 400 is a vehicle that is capable of automatic, unmanned traveling on a road. Each autonomous vehicle 400 receives a command that is transmitted from the traffic management server 100 via the network N1, and performs autonomous traveling based on the command. For example, the autonomous vehicle 400 may be a vehicle that travels along a predetermined route to transport people or cargos, or may be a vehicle that transports a shop, a facility or equipment that is loaded. Furthermore, the autonomous vehicle 400 may be a vehicle that travels along a predetermined round route for surveillance or crime prevention, for example.

Figure 8:
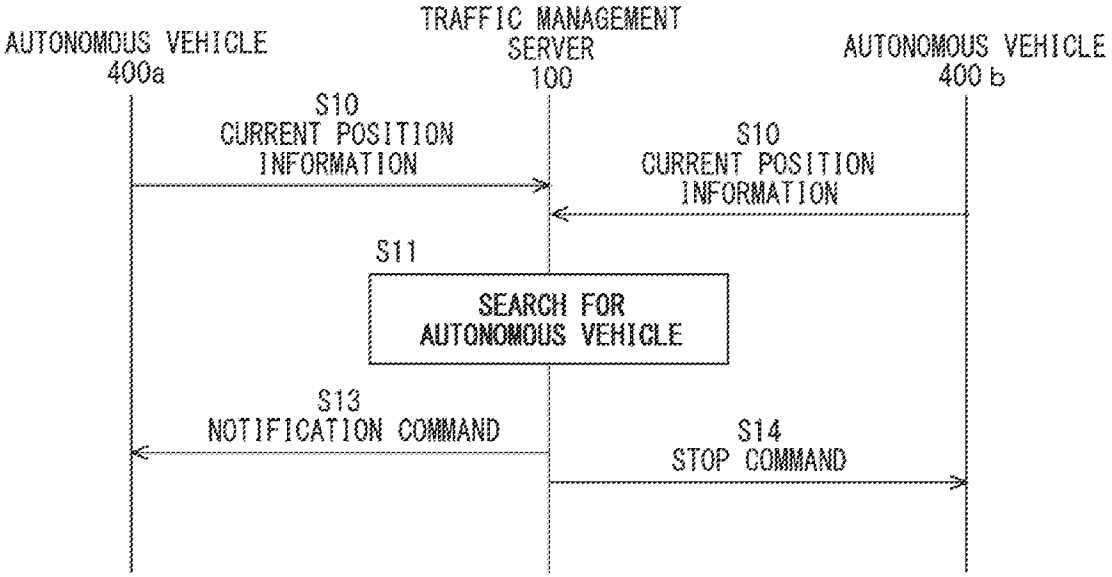
FIG. 8 is a sequence diagram according to the third embodiment, illustrating flows of information and processes of the traffic management system at a time of traveling of an emergency vehicle.

In the present embodiment, at the time of traveling of an emergency vehicle, the traffic management server 100 controls traveling of the autonomous vehicle 400, in addition to performing control of road surface display by the display apparatus 200 described in the first embodiment or the second embodiment. In the following, information processing that is performed in the present embodiment by the traffic management system 1 to control traveling of the autonomous vehicle 400 will be described with reference to FIG. 8. FIG. 8 is a sequence diagram illustrating flows of information and processes of the traffic management system 1 at a time of traveling of an emergency vehicle. Additionally, in FIG. 8, two autonomous vehicles 400 that perform communication with the traffic management server 100 are represented by autonomous vehicles 400*a*, 400*b*.

In the present embodiment, at the time of traveling of an emergency vehicle, the traffic management server 100 receives current position information from each of the autonomous vehicles 400 (S10). Furthermore, the traffic management server 100 searches for the autonomous vehicles traveling on the road on the scheduled travel route of the emergency vehicle, based on the current position information of each autonomous vehicle 400 that is received (S11).

Then, the traffic management server 100 transmits a notification command to the autonomous vehicle 400*a* traveling on the road on the scheduled travel route of the emergency vehicle, the notification command being for notifying other vehicles in the periphery to move over from a lane that is set as the special lane and to not enter the lane that is set as the special lane (S13). The autonomous vehicle 400*a* receiving such a notification command from the traffic management server 100 notifies other vehicles traveling in the periphery of the subject vehicle to move over from the lane that is set as the special lane and to not enter the lane that is set as the special lane. Additionally, notification to other vehicles at this time may be performed by sound. Furthermore, in the case where the autonomous vehicle 400*a* includes an external vehicle display, notification to other vehicles may be performed by display of text or the like on the external vehicle display.

Figure 9:
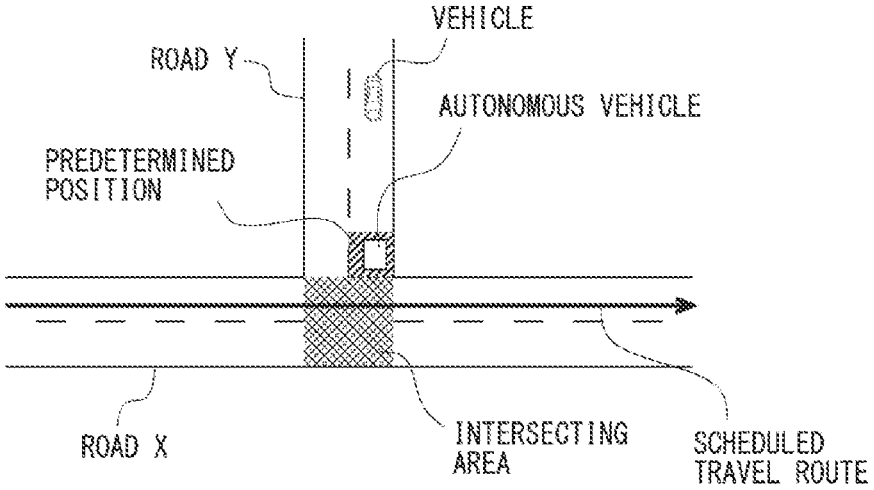
FIG. 9 is a diagram for describing an example of a predetermined position according to stop command.

Furthermore, the traffic management server 100 transmits, to the autonomous vehicle 400*b* traveling on the road on the scheduled travel route of the emergency vehicle, a stop command to stop at a predetermined position at which entry of another vehicle into the lane that is set as the special lane may be prevented (S14). The predetermined position here is a position on another road (road Y) that intersects the road (road X), where the special lane is set, at an intersecting area (a so-called intersection), the position being adjacent to the intersecting area. In FIG. 9, the intersecting area is indicated by the shaded area. The autonomous vehicle 400*b* receiving such a stop command from the traffic management server 100 stops at the predetermined position and thus prevents another vehicle from entering the lane that is set as the special lane. Additionally, the traffic management server 100 may transmit the notification command or the stop command to a plurality of autonomous vehicles 400. Moreover, the traffic management server 100 may transmit the notification command and the stop command to one autonomous vehicle 400.

When the traffic management server 100 controls traveling of the autonomous vehicle 400 in the manner described above, in addition to controlling road surface display by the display apparatus 200, other vehicles may be more urged to move over from the lane that is set as the special lane and to not enter the lane that is set as the special lane. Accordingly, at the time of an emergency vehicle traveling on the scheduled travel route to a destination, traveling may be better prevented from being obstructed by other vehicles.

OTHER EMBODIMENTS

The embodiments described above are merely examples, and the present disclosure may be changed and implemented as appropriate within the scope of the disclosure. Furthermore, processes and means described in the present disclosure may be freely combined to the extent that no technical conflict exists.

Furthermore, a process that is described to be performed by one apparatus may be shared and performed by a plurality of apparatuses. Processes described to be performed by different apparatuses may be performed by one apparatus. Which function is to be implemented by which hardware configuration (server configuration) in a computer system may be flexibly changed.

The present disclosure may also be implemented by supplying computer programs for implementing the functions described in the embodiments described above to a computer, and by one or more processors of the computer reading out and executing the programs. Such computer programs may be provided to the computer by a non-transitory computer-readable storage medium that can be connected to a system bus of the computer, or may be provided to the computer through a network. The non-transitory computer-readable storage medium may be any type of disk including magnetic disks (floppy (registered trademark) disks, hard disk drives (HDDs), etc.) and optical disks (CD-ROMs, DVD discs, Blu-ray discs, etc.), and any type of medium suitable for storing electronic instructions, such as read-only memories (ROMs), random access memories (RAMs), EPROMs, EEPROMs, magnetic cards, flash memories, or optical cards.

What is claimed is:

1. An information processing apparatus comprising a controller that is configured to:

set a special lane for traveling of an emergency vehicle on a road on a scheduled travel route along which the emergency vehicle travels to reach a destination;

transmit a display command to display the special lane to a display apparatus that displays information along a lane on a road surface of the road on the scheduled travel route; and transmit, to an autonomous vehicle traveling on the road on the scheduled travel route, a notification command to notify another vehicle of moving-over from a lane that is set as the special lane and of a prohibition on entry into the lane that is set as the special lane.

2. The information processing apparatus according to claim 1, wherein the controller is further configured to acquire a scheduled time at which the emergency vehicle passes through each section obtained by dividing the scheduled travel route into a plurality of sections, and the controller transmits the display command to the display apparatus so that the special lane is displayed on a road surface of a road in each section of the scheduled travel route from a time point that is a predetermined time before the scheduled time.

3. The information processing apparatus according to claim 1, wherein the controller is further configured to determine a number of lanes to be set as the special lane, based on a number of emergency vehicles scheduled to travel on the scheduled travel route.

4. The information processing apparatus according to claim 1, wherein the display apparatus includes a plurality of light emitting bodies that are embedded in the road surface of the road, along the lane, and displays information on the road surface of the road by causing at least one of the plurality of light emitting bodies to emit light.

5. The information processing apparatus according to claim 1, wherein the controller is further configured to transmit, to an autonomous vehicle traveling on the road on the scheduled travel route, a stop command to stop at a predetermined position at which entry of another vehicle into a lane that is set as the special lane is preventable.

6. The information processing apparatus according to claim 5, wherein the predetermined position is a position on another road that intersects the road, where the special lane is set, at an intersecting area, the position being adjacent to the intersecting area.

7. An information processing method to be performed by a computer, the information processing method comprising:

setting a special lane for traveling of an emergency vehicle on a road on a scheduled travel route along which the emergency vehicle travels to reach a destination;

transmitting a display command to display the special lane to a display apparatus that displays information along a lane on a road surface of the road on the scheduled travel route; and transmitting, to an autonomous vehicle traveling on the road on the scheduled travel route, a notification command to notify another vehicle in periphery of moving-over from a lane that is set as the special lane and of a prohibition on entry into the lane that is set as the special lane.

8. The information processing method according to claim 7, further comprising acquiring a scheduled time at which the emergency vehicle passes through each section obtained by dividing the scheduled travel route into a plurality of sections, wherein the display command is transmitted to the display apparatus so that the special lane is displayed on a road surface of a road in each section of the scheduled travel route from a time point that is a predetermined time before the scheduled time.

9. The information processing method according to claim 7, further comprising determining a number of lanes to be set as the special lane, based on a number of emergency vehicles scheduled to travel on the scheduled travel route.

10. The information processing method according to claim 7, further comprising transmitting, to an autonomous vehicle traveling on the road on the scheduled travel route, a stop command to stop at a predetermined position at which entry of another vehicle into a lane that is set as the special lane is preventable.

11. The information processing method according to claim 10, wherein the predetermined position is a position on another road that intersects the road, where the special lane is set, at an intersecting area, the position being adjacent to the intersecting area.

12. A system comprising a display apparatus that is configured to display information along a lane on a road surface of a road, an information processing apparatus, and one or a plurality of autonomous vehicles, wherein the information processing apparatus sets a special lane for traveling of an emergency vehicle on a road on a scheduled travel route along which the emergency vehicle travels to reach a destination, and transmits a display command to display the special lane on a road surface of the road on the scheduled travel route to the display apparatus, the display apparatus receiving the display command displays the special lane on the road surface of the road on the scheduled travel route, and the information processing apparatus transmits, to an autonomous vehicle traveling on the road on the scheduled travel route, among the one or plurality of autonomous vehicles, a notification command to notify another vehicle of moving-over from a lane that is set as the special lane and of a prohibition on entry into the lane that is set as the special lane.

13. The system according to claim 12, wherein the information processing apparatus acquires a scheduled time at which the emergency vehicle passes through each section obtained by dividing the scheduled travel route into a plurality of sections, and transmits the display command to the display apparatus so that the special lane is displayed on a road surface of a road in each section of the scheduled travel route from a time point that is a predetermined time before the scheduled time, and the display apparatus receiving the display command displays the special lane on the road surface of the road on the scheduled travel route from the time point that is the predetermined time before the scheduled time, on the road surface of the road in each section of the scheduled travel route.

14. The system according to claim 12, wherein the information processing apparatus determines a number of lanes to be set as the special lane, based on a number of emergency vehicles scheduled to travel on the scheduled travel route.

15. The system according to claim 12, wherein the display apparatus includes a plurality of light emitting bodies that are embedded in the road surface of the road, along the lane, and displays information on the road surface of the road by causing at least one of the plurality of light emitting bodies to emit light.

16. The system according to claim 12, wherein the information processing apparatus transmits, to an autonomous vehicle traveling on the road on the scheduled travel route, a stop command to stop at a predetermined position at which entry of another vehicle into a lane that is set as the special lane is preventable.

17. The system according to claim 16, wherein the predetermined position is a position on another road that intersects the road, where the special lane is set, at an intersecting area, the position being adjacent to the intersecting area.

* * * * *